US005611277A

United States Patent [19]

Bayer et al.

[11] Patent Number: 5,611,277

[45] Date of Patent: Mar. 18, 1997

[54] SHEET-CONVEYING DRUM FOR PRINTING MACHINES

[75] Inventors: Harald Bayer, Rodgau; Klemens Kemmerer, Seligenstadt, both of Germany

[73] Assignee: MAN Roland Druckmaschinen AG

[21] Appl. No.: 529,515

[22] Filed: Sep. 18, 1995

[30] Foreign Application Priority Data

Sep. 23, 1994 [DE] Germany ..... 44 33 999.2

[51] Int. Cl.[6] ..... B41F 13/24

[52] U.S. Cl. ..... 101/232; 271/82; 271/206; 271/277; 101/409

[58] Field of Search ..... 101/232, 408, 101/409, 410, 411, 415.1; 271/206, 277, 82

[56] References Cited

U.S. PATENT DOCUMENTS

| | | | |
|---|---|---|---|
| 4,848,230 | 7/1989 | Haupenthal | 101/232 |
| 5,390,601 | 2/1995 | Fricke et al. | 101/409 |
| 5,398,606 | 3/1995 | Becker | 101/409 |
| 5,398,609 | 3/1995 | Stiel | 101/415.1 |
| 5,516,096 | 5/1996 | Whiteside et al. | 101/409 |

FOREIGN PATENT DOCUMENTS

| | | |
|---|---|---|
| 3428668C2 | 4/1989 | Germany . |
| 2098966 | 12/1982 | United Kingdom . |

*Primary Examiner*—Eugene H. Eickholt
*Attorney, Agent, or Firm*—Leydig, Voit & Mayer, Ltd.

[57] ABSTRACT

A sheet-conveying drum for use between units in a printing machine is provided with a plurality of gripper bridges arranged substantially circumferentially symmetrically on the drum surface. The gripper bridges include gripper impact strips that are adjustable substantially radially relative to the drum in order to accommodate printing materials of different thickness. Each gripper impact strip is adjusted by means of a positioning device that is arranged on the drum radially inward of the gripper impact strip and mounted so that it can move axially relative to the drum and cam the gripper impact strip radially. The axial movement of each positioning device is brought about by an adjusting means which is selectively operated by a drive that is disposed in one of the drum journals. The adjusting means includes a gear coupling and a shaft associated with each positioning device which is rotatably mounted on the drum and coupled to the corresponding positioning device so that rotation of the shaft moves the positioning rod in the axial direction. Each shaft is rotated by the engagement of external toothing on the shaft with a corresponding toothed rack which is included in the gear coupling. The toothed racks are adapted so that only one engages its corresponding shaft at any given time thereby resulting in individual adjustment of the gripper impact strips.

11 Claims, 2 Drawing Sheets

SHEET-CONVEYING DRUM FOR PRINTING MACHINES

FIELD OF THE INVENTION

The present invention relates generally to printing machines, and more particularly to a sheet-conveying drum in a sheet-processing printing machine.

BACKGROUND OF THE INVENTION

Typically, sheet-conveying drums are located between the printing units and between the further-processing units, such as varnishing works, of a rotary printing machine. A sheet-conveying drum generally has one or more gripper bridges that are distributed evenly about the circumferential surface of the drum. These gripper bridges hold the sheets of paper to the drum enabling the drum to convey the sheets from the previous unit to the next unit downstream in the printing machine. In order to accommodate sheets of different thickness, the gripper bridges have adjustable gripper impact strips.

A sheet-conveying drum of this type is known from DE 3,428,668 C2, in which the drum has a central adjustment mechanism for adjusting the gripper pads in each of the gripper bridges to accommodate sheets of different thickness. The central adjustment mechanism is arranged on the drum body and acts on a positioning mechanism which acts on means that simultaneously adjusts all of the gripper pads. Further, the central adjustment mechanism can be driven by a motor and controlled from a control panel. However, the central adjustment mechanism is not capable of separately adjusting each individual gripper pad. An individual adjustment of each gripper impact strip can only be accomplished by releasing the retained central adjustment mechanism and manually adjusting the individual gripper impact strips. Since it is not easy to individually adjust each gripper pad, inaccuracies in sheet receiving or sheet transferring between sheet transfer cylinders cannot be effectively remedied. This could lead to slipping or tearing of the sheets which would disrupt the registry of the sheets resulting in lower quality printing. In addition, adjustment of the gripper pads is quite complicated and time consuming, requiring both a basic adjustment step and a fine adjustment step. This leads to increased production down time, since the printing press must be shut down in order to adjust the gripper pads for a new sheet thickness.

GB 2,098,966 A discloses a sheet-conveying cylinder having a mechanism for adjusting the gripper pads in a gripper bridge for sheets of different thickness. The gripper pads for the gripper bridge are mounted on a gripper pad bar which extends axially to the cylinder. The mechanism comprises an adjusting rod which is arranged radially inward of the gripper pad bar and in contacting relation therewith and a plurality of adjustment screws that threadedly extend through the adjustment bar. The contact surfaces of the adjustment bar and the gripper pad bar are complimentarily slanted in the transverse direction of the bars. Angular movement of the adjustment screws causes the adjustment bar to move thereby displacing the gripper pad bar radially inward or outward to accommodate a different sheet thickness. This type of adjustment mechanism is undesirable because a significant amount of time is required to adjust the gripper bridge for a different sheet thickness since a plurality of screws must manually adjusted.

OBJECTS AND SUMMARY OF THE INVENTION

It is an object of the invention to provide a sheet-conveying drum that has gripper bridges which can be individually adjusted for printing materials of different thickness.

It is a related object of the invention to provide a sheet-conveying drum that has gripper bridges that can be adjusted quickly and easily with a minimum of down time for the printing machine.

In accordance with these and other objects of the invention, a sheet-conveying drum is provided for use in a rotary printing machine. The sheet-conveying drum includes a plurality of gripper bridges which are arranged symmetrically on the surface of the drum. Each gripper bridge can be adjusted individually in order accommodate printing material of different thickness. Each gripper bridge consists of a gripper shaft, grippers, and gripper impact strips which are adjustable in substantially the radial direction. Each gripper bridge is paired with a positioning device which comprises a positioning rod having a plurality of attached wedge-shaped elements. The positioning rod is arranged on the drum radially inward of the gripper impact strip and is mounted so that it can move axially relative to the drum. The wedge-shaped elements are spring loaded into contacting relation with a plurality of complimentarily slanted wedge-shaped elements on the underside of the gripper impact strip. Thus, axial movement of the positioning rod cams the gripper impact strip in the radial direction.

The axial movement of each positioning device is brought about by an adjusting means associated with each positioning device which is selectively operated by a drive. The adjusting means includes a gear coupling and a rotatable shaft which is eccentrically coupled to its corresponding positioning device so that rotation of the shaft causes the positioning device to move in the axial direction. The drive is disposed in one of the journals which support the drum and operates the adjusting means through the gear coupling. Each shaft is rotated by the engagement of toothing formed on each shaft with a corresponding toothed rack which is part of the gear coupling. The toothed racks are adapted so that only one toothed rack is in engagement with its corresponding shaft at any time. In particular, each toothed rack includes a toothed segment whose position on the toothed rack is offset from the position of the toothed segments on the other toothed racks. In this manner, the gripper impact strips can be adjusted individually.

These and other features and advantages of the invention will be more readily apparent upon reading the following description of a preferred exemplified embodiment of the invention and upon reference to the accompanying drawings wherein:

DETAILED DESCRIPTION OF THE PREFERRED EMBODIMENT

Figure 1:
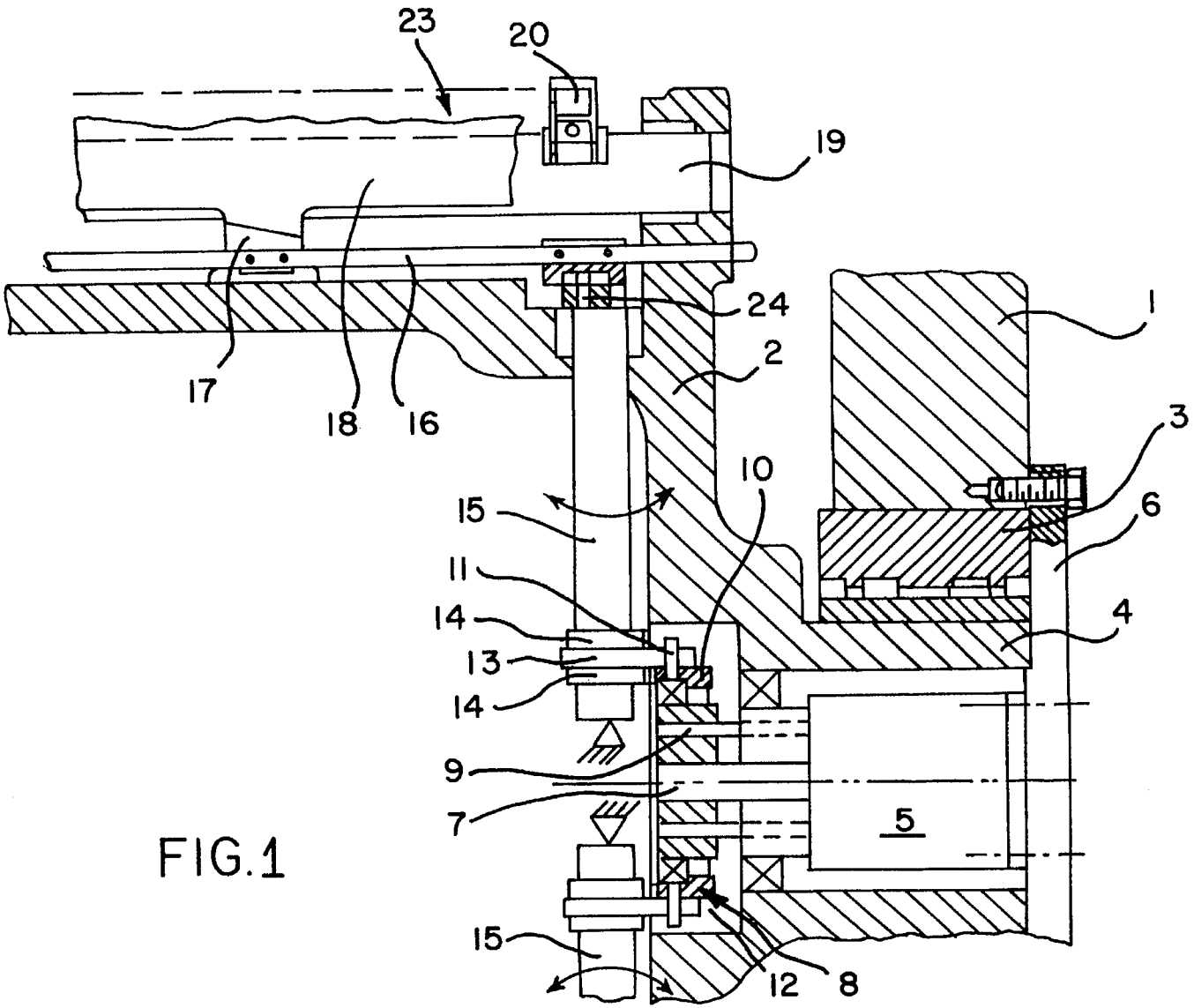
FIG. 1 is a partial front view of a sheet-conveying drum having two gripper bridges of the present invention.

FIG. 1 illustrates in schematic form a sheet-conveying drum 2 which is arranged in an offset printing machine between the impression cylinders of two printing units. The illustrated drum 2 is double-sized in relation to a single-size impression cylinder and thus has two gripper bridges 23 arranged circumferentially symmetrically (offset by 180°) on the surface of the drum 2. While the illustrated embodiment is a double-sized sheet conveying drum it is understood that the present invention is suitable for single-size to quadruple-sized drums having the corresponding number of gripper bridges arranged symmetrically on the surface of the drum. In addition, the invention is suitable for sheet transfer cylinders, pregripper cylinders, and feeder drums. Each gripper bridge 23 consists of a gripper shaft 19, grippers 20, and gripper impact strips 18 which are adjustable in substantially the radial direction. For each gripper 20 the gripper impact strip 18 includes associated pad blocks for the individual gripper pads. The drum 2 is rotatably supported by two journals 4 each of which is mounted in a bearing 3 in the opposed side frames 1 of the printing machine.

Each gripper impact strip 18 has an associated positioning means or device that can adjust the gripper impact strip 18 either radially inward or outward depending on the thickness of the printing material. The positioning device is mounted on the drum 2 so that it can move axially relative to the drum. The illustrated double-size drum has two positioning devices arranged on the drum. Each positioning device comprises a positioning rod 16 having a plurality of attached wedge-shaped elements 17 which are slanted longitudinally of the rod 16. The positioning rod 16 is arranged on the body of the drum 2 radially inward of the gripper impact strip 18 and moves axially relative to the drum. The wedge-shaped elements 17 on the positioning rod 16 are in contacting relation with a plurality of complimentarily slanted wedge-shaped elements disposed on the gripper impact strip 18 so that axial movement of the positioning rod 16 cams the gripper impact strip 18 in a substantially radial direction. The complimentary wedge shaped elements on the gripper impact strip 18 and the positioning rod 16 are held in contacting relation with each other by the bias of springs.

Each positioning device is moved in the axial direction by an associated adjusting means which is selectively operated by a drive 5 and includes a gear coupling 12 and a shaft 15. The drive 5 is disposed in one of the drum journals 4 and is fixed to the side frame via a fastener 6. The drive 5 is preferably a controllable electric motor and includes a drive shaft 7 which in combination with straight guides 8, 9 forms a helical gear. In particular, the straight guides 8,9 are slidably mounted in the drum journal 4 and coupled via a gear mechanism to the drive shaft 7 so that rotation of the drive shaft 7 moves the straight guides 8,9 in the axial direction relative to the drive shaft 7. A ring 10 is mounted rotatably on the periphery of the straight guides 8, 9. A toothed rack 13 is coupled via a turning knuckle 11 to the ring 10 for each positioning device. Each toothed rack 13 has a toothed segment 22 which can be brought into engagement with external toothing on a shaft 15. Each toothed rack 13 is guided on its corresponding adjusting means by adjusting rings 14. Each shaft 15 is mounted rotatably in the area of the axis of rotation of the drum 2 so that it extends radially towards the surface of the drum 2. The shaft 15 is eccentrically coupled to its corresponding positioning rod 16 by a coupling bracket 24 so that rotation of the shaft 15 is translated into axial movement of the positioning rod 16. The drive shaft 7, straight guides 8, 9, ring 10, turning knuckle 11, toothed rack 13, and the external toothing on the shaft 15 form the gear coupling 12.

Figure 2:
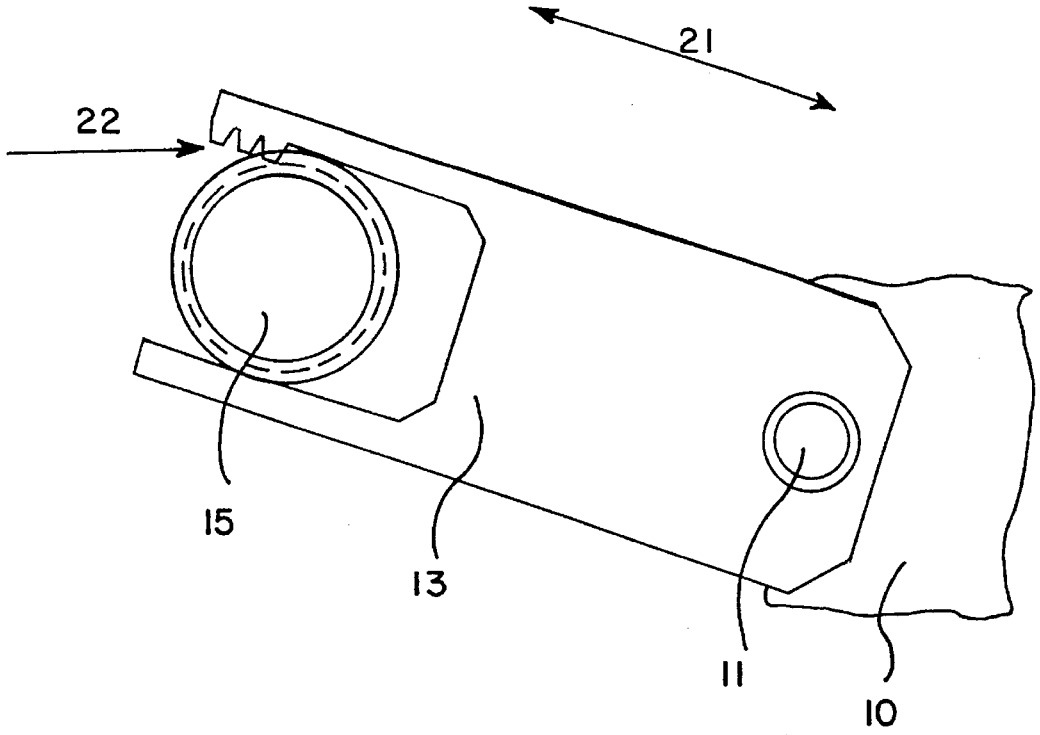
FIG. 2 is a top view showing one of the toothed rack portions of the gear coupling of the present invention.
Figure 3:
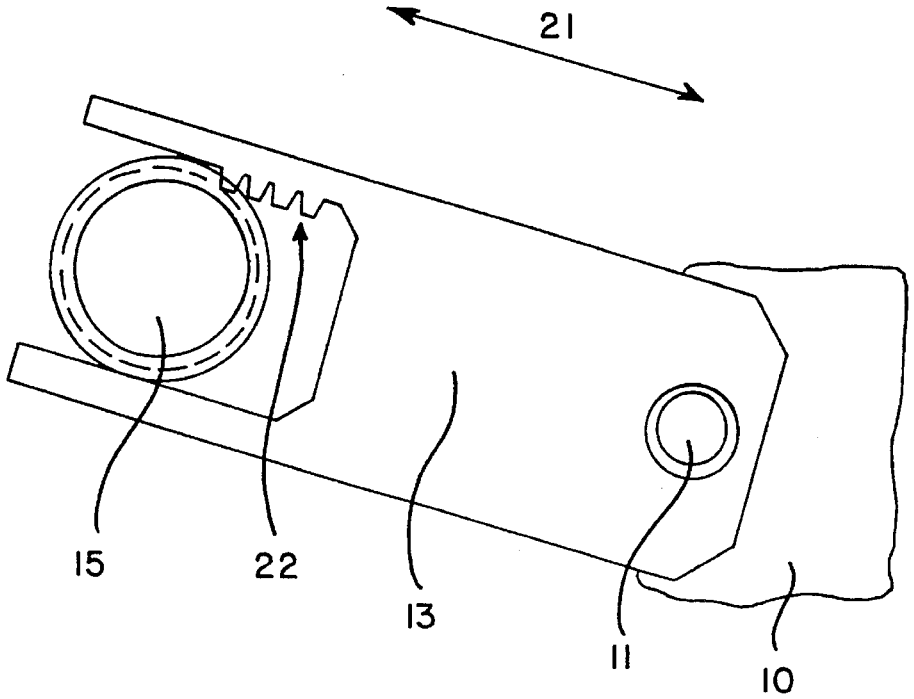
FIG. 3 is a top view showing the other toothed rack portion of the gear coupling of the present invention While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

In the illustrated embodiment of a double-size drum two toothed racks 13 are coupled symmetrically on the ring 10 (offset by 180°) in each case via a turning knuckle 11. In order to allow for sequential adjustment of the gripper impact strips, the locations of the toothed segments 22 of the two toothed racks 13 are offset. For example, FIGS. 2 and 3 depict how the toothed segments 22 of the toothed racks 13 are arranged for a drum 2 having two gripper bridges 23. The offset arrangement ensures that only one toothed rack 13 is engaged with its corresponding adjusting means at any given time. Likewise in a triple-size drum, three toothed racks would be coupled to the ring (offset by 120°) with the toothed racks having toothed segments which were arranged in such a way that only one toothed rack is engaged with its corresponding adjusting means at any given time. Those skilled in the art can appreciate that single-size and quadruple-size drums can be provided using a similar arrangement with the drum having one toothed rack and four toothed racks (offset by 90°), respectively.

In an alternative embodiment, two toothed racks would act on each adjusting means. Each adjusting means would have two external toothed segments which would engage simultaneously with its corresponding toothed rack. In another alternative embodiment, the toothed racks and external toothing on the adjusting means would be replaced by a gear coupling. The gear coupling would comprise at least one coupling rod attached to the ring via a turning knuckle and attached to the adjusting means via a turning knuckle.

The mode of operation is as follows: A sheet is fed to the drum 2 by an cylinder in an upstream printing unit. The drum receives the sheet with one of its gripper bridges 23. The sheet is then conveyed and subsequently passed on to an impression cylinder in a downstream printing unit. When it is necessary to process a material having a different thickness the gripper impact strips 18 on the drum 2 have to be adjusted either higher or lower. In order to make this adjustment, first, the drive 5 is activated either manually or automatically, for example from a control panel. The drive 5 sets the drive shaft 7 in motion. The drive shaft 7 and the straight guides 8,9 form a helical gear, such that the drive shaft 7 acts as drive member and the straight guide acts as an output drive member. Thus, the straight guide 8,9 moves in an axial direction relative to the drive shaft 7 which in turn moves the ring 10 axially. This movement in the axial direction 22 is depicted in FIGS. 2 and 3. The ring 10 transmits the axial movement via the toothed rack 13 to the rotatable shaft 15 causing it to rotate. The shaft 15 is eccentrically coupled to the positioning rod 16 so that rotation of the adjusting means 15 translates into axial movement of the positioning rod 16 thus camming the gripper impact strip 18 in the radial direction. The toothed segment 22 of the toothed rack 13 is adapted so that it is engaged with the external toothing of the adjusting means 15 only in a defined region. When the toothed rack 13 leaves that region the toothed segment 22 is no longer engaged with the adjusting means 15, therefore, the adjusting means does not rotate.

The illustrated drum 2 has two gripper impact strips 18 each of which is coupled to an shaft 15 which is turned separately and sequentially by a toothed rack 13. In other words, when the first toothed rack is engaged with the first shaft the second toothed rack is in the defined region where it is not in engagement with the second shaft and vice versa. This permits individual adjustment of each gripper impact strip 18. If the drum were provided with three or four gripper impact strips the adjustment takes place in a similar manner with only one toothed segment of a toothed rack engaged with its corresponding shaft at any given time.

While this invention has been described with an emphasis upon preferred embodiments, it will be obvious to those of ordinary skill in the art that variations of the preferred embodiments may be used and that it is intended that the invention may be practiced otherwise than as specifically described herein. Accordingly, this invention includes all modifications encompassed within the spirit and scope of the invention as defined by the following claims.

We claim as our invention:

1. A sheet-conveying drum for conveying sheets of different thickness between two units of a printing machine having opposing side frames wherein said drum is rotatably supported by a pair of journals each of which are mounted in a bearing in one of said opposing side frames, said drum comprising, in combination, a plurality of gripper bridges arranged substantially circumferentially symmetrically on the surface of said drum, each of said gripper bridges including a gripper shaft, grippers, and gripper impact strips, wherein said gripper impact strips are adjustable substantially radially relative to said drum, positioning means having an operating end associated with each of said gripper impact strips for causing said gripper impact strips to be moved in the radial direction relative to said drum when said positioning means is actuated, and adjusting means including a gear coupling associated with each of said positioning means for actuating said positioning means, and drive means disposed in one of said journals for selectively operating said adjusting means through said gear coupling to actuate said positioning means.

2. A sheet-conveying drum as defined in claim 1 wherein said gripper impact strips include a plurality of wedge-shaped elements attached thereto and said positioning means includes an axially movable positioning rod having a plurality of complimentary wedge-shaped elements attached thereto that are in contacting relation with said plurality of wedge-shaped elements attached to said gripper impact strip whereby axial movement of said positioning rod acts to cam said gripper impact strip in the substantially radial direction.

3. A sheet-conveying drum as defined in claim 1 wherein the drive means is a controllable electric motor having a drive shaft.

4. A sheet-conveying drum as defined in claim 3 wherein said adjusting means includes a shaft rotatably mounted on said drum and said gear coupling includes helical gear means coupled with toothed rack means associated with each said shaft wherein said toothed gear means periodically engages said shaft.

5. A sheet-conveying drum as defined in claim 4 wherein said helical gear means includes said drive shaft, straight guides which are slidably mounted in said one of said drum journals and coupled to said drive shaft by gearing means for translating rotation of said drive shaft into movement of said straight guides in the axial direction relative to said drive shaft, and a ring which is rotatably mounted on said periphery of said straight guide.

6. A sheet-conveying drum as defined in claim 4 wherein said shaft has external toothing formed therein and said toothed rack means includes a complimentary toothed segment formed therein that periodically engages said external toothing on said adjusting means.

7. A sheet-conveying drum as defined in claim 6 wherein said toothed segments of said toothed rack means are adapted so that only one of said toothed segments is engaged with said shaft associated with said toothed rack means at any time.

8. A sheet-conveying drum as defined in claim 1 wherein said drum has two gripper bridges.

9. A sheet-conveying drum as defined in claim 1 wherein said drum has three gripper bridges.

10. A sheet-conveying drum as defined in claim 1 wherein said drum has four gripper bridges.

11. A sheet-conveying drum for conveying sheets of different thickness between two units of a printing machine having opposing side frames wherein said drum is rotatably supported by a pair of journals each of which are mounted in a bearing in one of said opposing side frames, said drum comprising, in combination, a plurality of gripper bridges arranged substantially circumferentially symmetrically on the surface of said drum, each of said gripper bridges including a gripper shaft, a gripper, and a gripper impact strip, said gripper impact strips being adjustable substantially radially relative to said drum, at least one selectively actuatable positioning device associated with each of said gripper impact strip for causing said gripper impact strips to be moved in the radial direction relative to said drum when said positioning device is actuated, an adjusting device including a gear coupling for actuating the positioning devices, and a drive associated with one of said journals for selectively operating said adjusting device through said gear coupling to actuate said positioning devices.

* * * * *